US010556151B1

(12) United States Patent
Malykhin

(10) Patent No.: US 10,556,151 B1
(45) Date of Patent: Feb. 11, 2020

(54) SELF-PROPELLED PERSONAL FLOTATION DEVICE

(71) Applicant: Sergey Malykhin, Saint Thomas (CA)

(72) Inventor: Sergey Malykhin, Saint Thomas (CA)

( * ) Notice: Subject to any disclaimer, the term of this patent is extended or adjusted under 35 U.S.C. 154(b) by 0 days.

(21) Appl. No.: 15/956,549

(22) Filed: Apr. 18, 2018

(51) Int. Cl.

| | |
|---|---|
| ***A63B 35/12*** | (2006.01) |
| ***B63C 11/46*** | (2006.01) |
| ***B63C 9/00*** | (2006.01) |
| ***B63C 9/115*** | (2006.01) |

(52) U.S. Cl.
CPC ..... *A63B 35/12* (2013.01); *B63C 9/115* (2013.01); *B63C 11/46* (2013.01); *A63B 2225/605* (2013.01)

(58) Field of Classification Search
CPC ..... B63C 9/00; B63C 11/00; B63C 11/46; B63C 9/08; B63B 35/73; B63B 35/79; B63B 21/56; A63B 35/00; A63B 35/12; B60L 11/00; B60L 11/02
USPC ..... 114/315; 440/6, 38; 441/65, 80
See application file for complete search history.

(56) References Cited

U.S. PATENT DOCUMENTS

| | | | | |
|---|---|---|---|---|
| 2,312,976 | A | 3/1943 | Pels | |
| 3,442,240 | A * | 5/1969 | Loughman | A63B 35/12 114/315 |
| 5,158,034 | A | 10/1992 | Hsu | |
| 5,388,543 | A * | 2/1995 | Ditchfield | A63B 35/12 114/315 |
| 5,396,860 | A * | 3/1995 | Cheng | B63C 11/46 114/315 |
| 5,584,736 | A | 12/1996 | Salvemini | |
| 5,619,948 | A | 4/1997 | Keyvani | |
| 5,947,782 | A | 7/1999 | Siladke et al. | |
| 7,223,143 | B1 | 5/2007 | Martin | |
| 7,753,750 | B2 | 7/2010 | Gutierrez | |

* cited by examiner

*Primary Examiner* — Lars A Olson
(74) *Attorney, Agent, or Firm* — Cramer Patent & Design, PLLC; Aaron R. Cramer

(57) ABSTRACT

A self-propelled personal flotation apparatus provides a motorized flotation board which includes internal water propulsion equipment and associated push-button controls. In use, a user straps the apparatus onto their chest area, enters a body of water such as a lake, a pond, or a pool, and is propelled across the water surface.

12 Claims, 5 Drawing Sheets

SELF-PROPELLED PERSONAL FLOTATION DEVICE

RELATED APPLICATIONS

Not applicable.

FIELD OF THE INVENTION

The present invention relates to personal flotation devices and, more particularly, to self-propelled personal flotation device.

BACKGROUND OF THE INVENTION

Very few leisure time activities rival that of spending a warm summer day in the water. Whether the water is at the beach, in a lake, on a boat, or even in a backyard pool, safety should be one (1) of the prime considerations for all involved. Perhaps the most important piece of water safety gear is the flotation vest. Even if a non-swimmer should fall into deep water while wearing one (1), survival is almost assured. However, most flotation vests are large, bulky items. Wearing them while trying to swim or move about in the water is certainly difficult, and makes for a less than enjoyable experience. While difficulty swimming is an annoyance when relaxing or playing, it can become life threatening should a rescuer be trying to swim to reach another in peril. Accordingly, there exists a need to increase mobility of a personal flotation device.

SUMMARY OF THE INVENTION

The inventor has recognized the aforementioned, inherent problems and lack in the art and observed that there is a need for a new and improved self-propelled personal flotation device. The development of the present invention, which will be described in greater detail herein, fulfills this need.

In an embodiment, the disclosed self-propelled personal flotation device includes a board assembly and a propulsion assembly connected to the board assembly and configured to generate thrust for propulsion.

In another embodiment, the disclosed self-propelled personal flotation device includes a board structure having a first side and a second side, opposite the first side, a first propulsion assembly connected to the board assembly at the first side of the board structure and configured to generate first thrust for propulsion, and a second propulsion assembly connected to the board assembly at the second side of the board structure and configured to generate second thrust for propulsion.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWINGS

The advantages and features of the embodiments and examples disclosed herein will become better understood with reference to the following more detailed description and claims taken in conjunction with the accompanying drawings, in which like elements are identified with like symbols, and in which:

DESCRIPTIVE KEY

Figure 1:
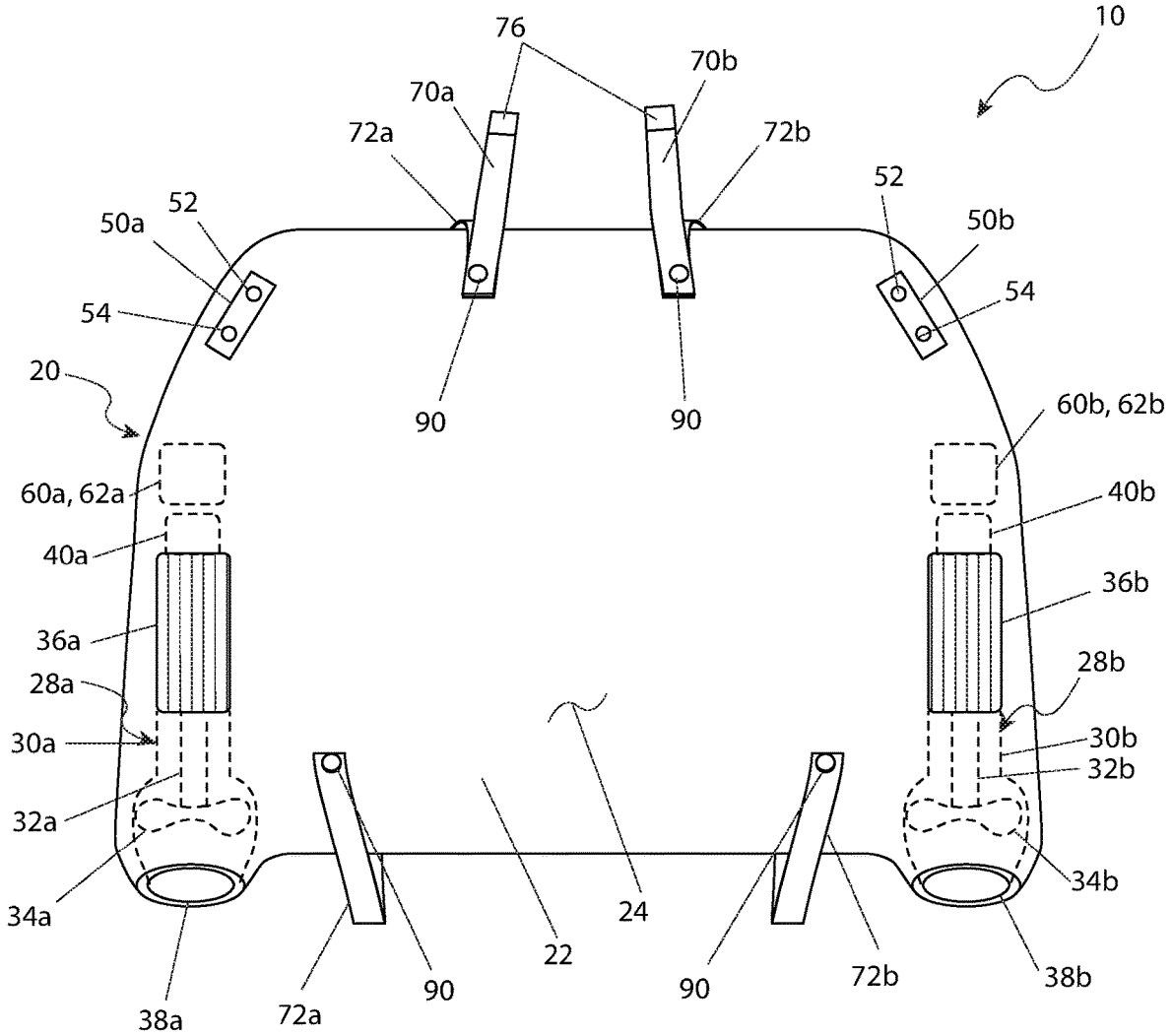
FIG. 1 is a bottom plan view of a disclosed self-propelled personal flotation device, in accordance with an embodiment of the present invention.

10 self-propelled personal flotation device
20 board assembly
22 board structure
24 bottom board surface
26 top board surface
28*a* first water propulsion assembly
28*b* second water propulsion assembly
30*a* first pump
30*b* second pump
32*a* first pump shaft
32*b* second pump shaft
34*a* first impeller
34*b* second impeller
36*a* first water intake grill
36*b* second water inlet grill
38*a* first water output nozzle
38*b* second water output nozzle
40*a* first pump motor
40*b* second pump motor
50*a* first motor control module
50*b* second motor control module
52 increase button switch
54 decrease button switch
60*a* first battery pack
60*b* second battery pack
62*a* first battery compartment
62*b* second battery compartment
64 battery compartment lid
66 compartment lid latch
70*a* first neck strap
70*b* second neck strap
72*a* first side strap
72*b* second side strap
74*a* first waist strap
74*b* second waist strap
76 hook-and-loop fastener
90 strap fastener
92 wiring
100 user
102 hand
105 water surface
110 inlet water
115 outlet water

DETAILED DESCRIPTION OF THE PREFERRED EMBODIMENT

In accordance with the invention, the best mode is presented in terms of the illustrative example embodiments, herein depicted within FIGS. 1-5. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one (1) particular configuration may be shown and described for purposes of clarity and disclosure and not by way of limitation of scope.

As used herein, the singular terms "a," "an," and "the" include plural referents unless the context clearly dictates otherwise. Thus, for example, reference to an object can include multiple objects unless the context clearly dictates otherwise.

As used herein, the terms "connect," "connected," and "connection" refer to a coupling or linking. Connected objects can be directly coupled to one (1) another or can be indirectly coupled to one another, such as via another object.

As used herein, the terms "first," "second," etc. are used merely as labels and do not impose any positional or hierarchical requirements on the item to which the term refers.

Figure 2:
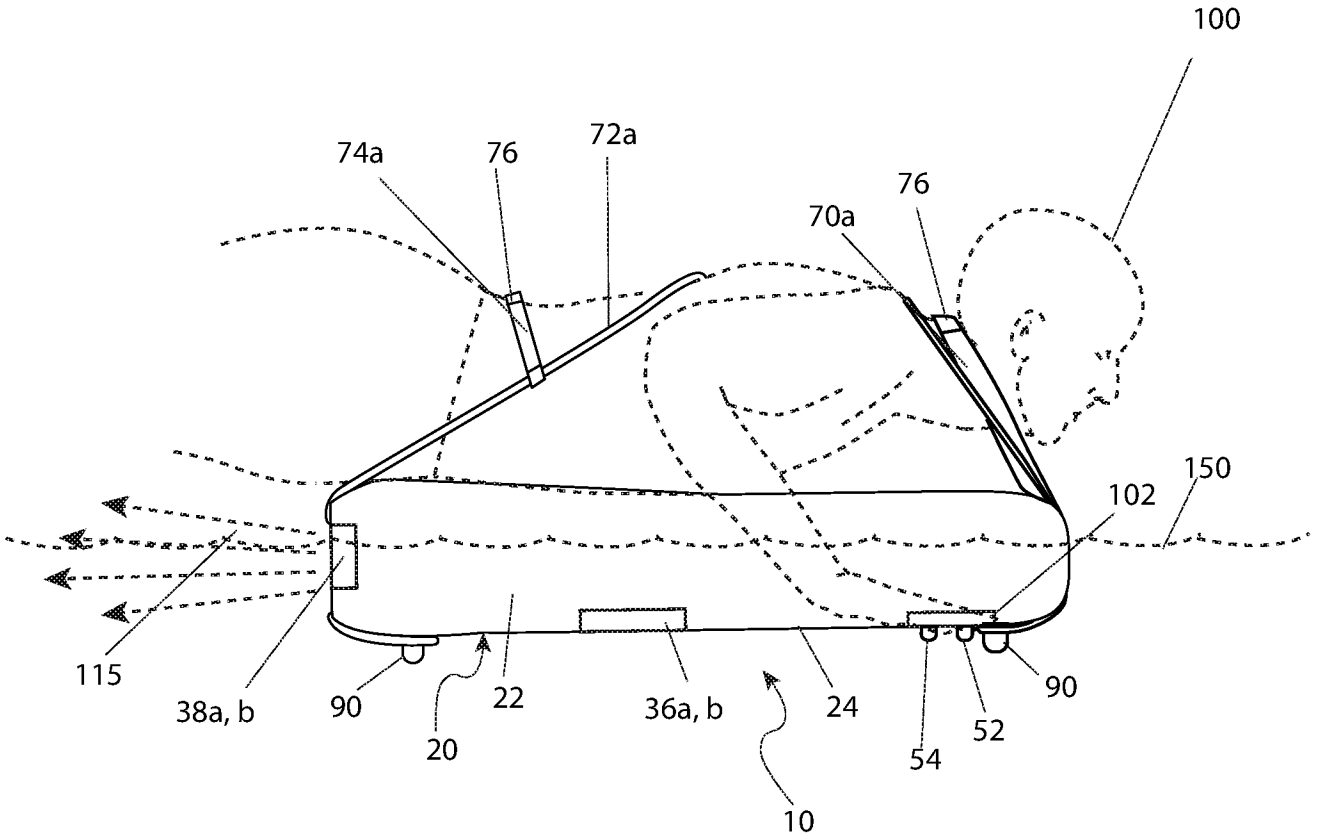
FIG. 2 is an environmental, side elevational view of the disclosed self-propelled personal flotation device, in accordance with an embodiment of the present invention.

Referring generally to FIGS. 1-5, disclosed is a self-propelled personal flotation device, generally referred to herein as the device, 10 where like reference numerals represent similar or like parts. Generally, the device 10 provides for single-person flotation having a propulsion system that automatically moves the device 10 and a user 100 across water. The device 10 may be utilized for recreational activities, for rescue purposes, and any other purpose. The device 10 includes a motorized flotation board that includes internal water propulsion equipment and associated push-button controls. In use, and as illustrated in FIG. 2, the user 100 rests their chest upon the device 10 and straps the device 10 onto their torso, enters a body of water (e.g., a lake, a pond, a pool and the like) and is propelled across the water surface.

Figure 3:
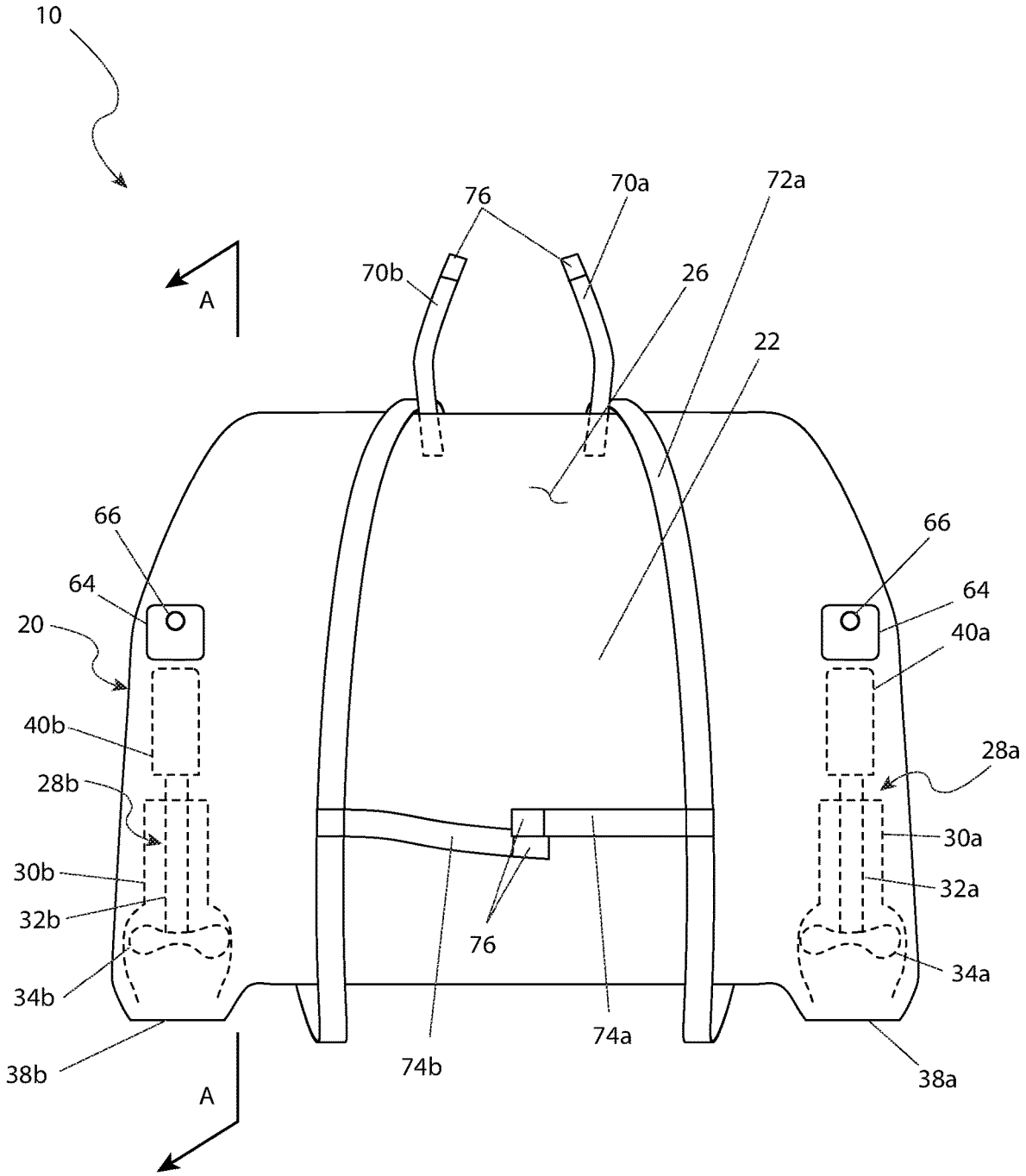
FIG. 3 is a top plan view of the disclosed self-propelled personal flotation device, according to an embodiment of the present invention.

Referring to FIGS. 1 and 3, the device 10 includes a personal flotation board assembly 20. In an example, the board assembly 20 has a size and/or a shape substantially similar to a boogieboard used for bodyboarding. The device 10 also includes at least one (1) water propulsion assembly, such as a dual water propulsion system including a first water propulsion assembly 28*a* and a second water propulsion assembly 28*b* (referred to individually as water propulsion assembly 28 or collectively as water propulsion assemblies 28).

The flotation board assembly 20 includes a board structure 22 having a generally rectangular shape with angled or curved forward corners for hydrodynamic purposes. The board structure 22 is made of a highly buoyant and lightweight foam material, such as polystyrene, polyurethane, and the like. The board structure 22 provides sufficient surface area to support to the torso of the user 100 (FIG. 2) as well as provide buoyancy on the water surface 105 (FIG. 2).

The board structure 22 includes a bottom board surface 24 and a top board surface 26 (FIG. 3). In an example construction, one (1) or more portions of the bottom board surface 24 of the board structure 22 is covered with a smooth plastic coating to reduce surface tension and improve hydrodynamic movement of the device 10 across the water surface 105.

In an example construction, the top board surface 26 of the board structure 22 is at least partially covered by a bonded fabric layer or foam-rubber layer to provide comfort for the user 100 during use.

In various examples, the device 10 is manufactured in different overall sizes, for example, which correspond to various users 100 from child sizes to adult sizes. Furthermore, it is envisioned that the device 10 be made available in attractive external colors, patterns, and prints based upon the user's 100 preferences.

In an example, the first water propulsion assembly 28*a* and the second water propulsion assembly 28*b* are located within opposing side portions of the board structure 22, respectively. In the illustrative example, the water propulsion assemblies 28 define two (2) mirror-image linear assemblies. The water propulsion assemblies 28 each respectively have a pump 30 (a first pump 30*a* and a second pump 30*b*), a pump shaft 32 (a first pump shaft 32*a* and second pump shaft 32*b*), an impeller 34 (a first impeller 34*a* and a second impeller 34*b*), a water intake grill 36 (a first water intake grill 36*a* and a second water intake grill 36*b*), a water output nozzle 38 (a first water output nozzle 38*a* and a second water output nozzle 38*b*), a pump motor 40 (a first pump motor 40*a* and a second pump motor 40*b*), a motor control module 50 (a first motor control module 50*a* and a second motor control module 50*b*), a battery pack 60 (a first battery pack 60*a* and a second battery pack 60*b*), and a battery compartment 62 (a first battery compartment 62*a* and a second battery compartment 62*b*).

In an example, the water propulsion assemblies 28*a*, 28*b* are arranged in a front-to-back linear fashion, being parallel to each other and located along each side portion of the board structure 22. The water intake grills 36*a*, 36*b* are located along opposing sides of the bottom board surface 24. In example constructions, the water intake grills 36*a*, 36*b* form rectangular or oval-shaped open grates that allow inlet water 110 (FIG. 4) to be sucked into the respective pumps 30*a*, 30*b* while straining out any debris that might be present along the water surface 105.

Each pump 30*a*, 30*b* includes a cylindrical housing structure containing a respective internal propeller-type impeller 34*a*, 34*b* being in mechanical communication with and being rotated by a respective pump motor 40*a*, 40*b* and a respective pump shaft 32*a*, 32*b*. The impellers 34*a*, 34*b* force outlet water 115 (FIGS. 2 and 4) through the pumps 30*a*, 30*b* and out a respective rear-mounted nozzle 38*a*, 38*b* to produce a thrust, which in turn motions the device 10 in a forward direction.

Figure 4:
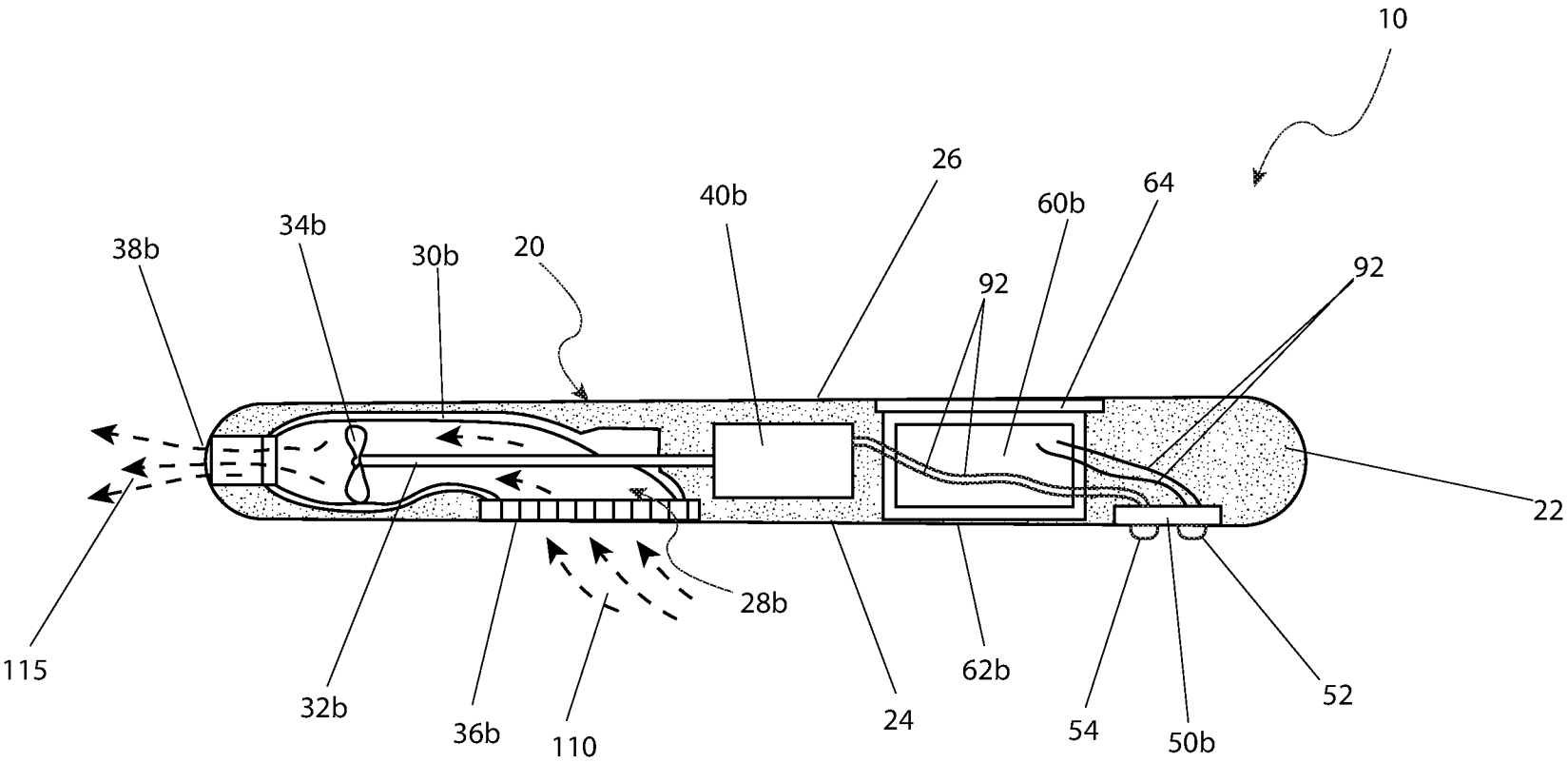
FIG. 4 is a side elevation, sectional view of the disclosed self-propelled personal flotation device, according to an embodiment of the present invention; and, FIG. 5 is a schematic electrical diagram of the disclosed self-propelled personal flotation device, according to an embodiment of the present invention.

The nozzles 38*a*, 38*b* form diametrically tapering structures, which terminate in a small rearward oval-shaped or circular aperture, terminating coincidental with a rear edge of the board structure 22. The nozzles 38*a*, 38*b* act to accelerate and increase the thrust produced by the outlet water 115 (FIGS. 2 and 4).

The board structure 22 also includes lifejacket-like attachment features, which enable secure attachment of the flotation board assembly 20 to the user 100. In an example, the device 10 includes a first neck strap 70*a* and a second neck strap 70*b*, a first side strap 72*a* and a second side strap 72*b*, and a first waist strap 74*a* and a second waist strap 74*b*.

The neck straps 70*a*, 70*b* are connected along a forward edge of the board structure 22 using strap fasteners 90, such as screws, rivets, and the like. During use, the neck straps 70*a*, 70*b* are adjustably connected around the user's 100 neck area via cooperating portions of an integral hook-and-loop fastener 76.

The side straps 72*a*, 72*b* are connected along the forward edge of the board structure 22 and connected along a rearward edge of the board structure 22, using additional strap fasteners 90. The side straps 72*a*, 72*b* are arranged in a parallel manner extending downwardly over shoulder portions of the user 100.

The waist straps 74*a*, 74*b* are connected (e.g., sewn) to respective side straps 72*a*, 72*b* at a location adjacent to the user's 100 waist area. The waist straps 74*a*, 74*b* are adjustably connected to each other across the user's 100 waist area via cooperating portions of another integral hook-and-loop fastener 76. The waist straps 74*a*, 74*b* and the side straps 72*a*, 72*b* together form an "H"-pattern (FIG. 3).

Referring to FIG. 2, the attachment of the neck straps 70*a*, 70*b* and the waist straps 74*a*, 74*b* provide secure positioning of the user 100 upon the flotation board assembly 20. The device 10 provides a buoyant support to the torso of the user 100 such that the water intake grills 36*a*, 36*b* are submerged below the water surface 105 and that a head of the user 100 is above the water surface 105.

In use, the control of the speed and direction of the device 10 is accomplished via a first motor control module 50*a* and a second motor control module 50*b*, each having an associated increase button switch 52 and decrease button switch 54 located along the bottom board surface 24 (FIGS. 1, 2 and 4). The increase button switch 52 and the decrease button switch 54 are positioned along opposing forward portions of the bottom board surface 24 of the flotation board assembly 20 being adjacent to a hand 102 of the user 100 for ease of operation. In an example, the button switches 52, 54 are waterproof single contact closure devices.

During use, the user 100 may press the increase button switches 52 in a repetitive manner to obtain a desired incremental speed upon the water surface 105 or to stop the forward motion of the device 10 by repeatedly pressing the decrease button switches 54.

During use, directional steering of the device 10 may be accomplished by differential adjustment of the trust of the first pump 30*a* and the second pump 30*b* using the button switches 52, 54 in a right-hand or left-hand biased manner. In an example, an optional means of steering of the device 10 may be accomplished by angling the legs of the user 100 with respect to the flotation board assembly 20 while in motion.

FIG. 4 illustrates an example of the second water propulsion assembly 28*b*, for example, taken along section line A-A of FIG. 3. The second water propulsion assembly 28*b* is located within one (1) side portion of the device 10. The second water propulsion assembly 28*b*, shown in FIG. 4, represents a mirror-image of the first water propulsion assembly 28*a* (FIGS. 1 and 3), which is located along the opposing side of the flotation board assembly 20.

The board structure 22 has a thickness sufficient to enclose and contain (e.g., completely surround) the water propulsion assemblies 28*a*, 28*b*. The water propulsion assemblies 28*a*, 28*b*, the battery packs 60*a*, 60*b*, and the speed control equipment 50*a*, 50*b*, are located within associated waterproof compartments integrated into an interior of the board structure 22.

In an example, the battery packs 60*a*, 60*b* are rectangular in shape and are contained within correspondingly shaped user-accessible first battery compartment 62*a* and second battery compartment 62*b*. The battery compartments 62*a*, 62*b* are accessed through respective sealed and waterproof battery compartment lids 64 (FIG. 3), which are parallel to and flush with the top board surface 26. The battery compartment lids 64 are removably connected to the battery compartments 62*a*, 62*b* via respective compartment lid latches 66 (FIG. 3), thereby enabling convenient access of the included battery packs 60*a*, 60*b* for extraction and recharging as needed.

FIG. 4 illustrates the second pump 30*b*, the second pump shaft 32*b*, the second impeller 34*b*, the second water intake grill 36*b*, the second water output nozzle 38*b*, the second pump motor 40*b*, the second motor control module 50*b*, the second battery pack 60*b*, and the second battery compartment 62*b* of the second water propulsion assembly 28*b*. The first pump 30*a*, the first pump shaft 32*a*, the first impeller 34*a*, the first water intake grill 36*a*, the first water output nozzle 38*a*, the first pump motor 40*a*, the first motor control module 50*a*, the first battery pack 60*a*, and the first battery compartment 62*a* of the first water propulsion assembly 28*a* is substantially the same as illustrated in FIG. 4. Therefore, the following description of the second water propulsion assembly 28*b* and the components thereof in reference to FIG. 4 can be equally applied to the first water propulsion assembly 28*a* and the components thereof.

The second pump 30*a* and its internal impeller 34*b* are in mechanical communication with the second pump motor 40*b* via the second pump shaft 32*b*. In an example, the second pump motor 40*b* is an electrical direct current (DC) brushless water-cooled unit or equivalent. The second pump 30*a*, the second impeller 34*b*, and the second pump motor 40*b* create a thrust that propels the inlet water 110 out the second water output nozzle 38*b*. The jet of outlet water 115 from the second water output nozzle 38*b* is directed parallel to the user's 100 body (FIG. 2). In an example, the second pump 30*a*, the second impeller 34*b*, and the second pump motor 40*b* are configured to produce a minimum of one-half horsepower (0.5 hp).

In an example, the second impeller 34*b* is approximately fifty-two millimeters (52 mm) in diameter and is capable of rotating a minimum of sixteen thousand revolutions per minute (16,000 rpm).

In an example, the second pump motor 40*b* is powered by a rechargeable fourteen and eight-tenths volt (14.8V) lithium-ion battery pack 60*b* or other equivalent rechargeable power source and provides a minimum of eight amp-hours (8 Ah) of current.

In an example, the second pump 30*a*, the second impeller 34*b*, and the second pump motor 40*b* are configured to produce sufficient thrust and duration to motion the device 10 and an adult user 100 at a speed of fifteen kilometers per hour (15 km/hr) for twenty minutes (20 min.) or at a slower speed of six kilometers per hour (6 km/hr) for one hour (1 hr).

The device 10 also includes additional user-controlled electrical and electronic equipment to control the pump motors 40*a*, 40*b* and the speed of the device 10, during use.

Figure 5:
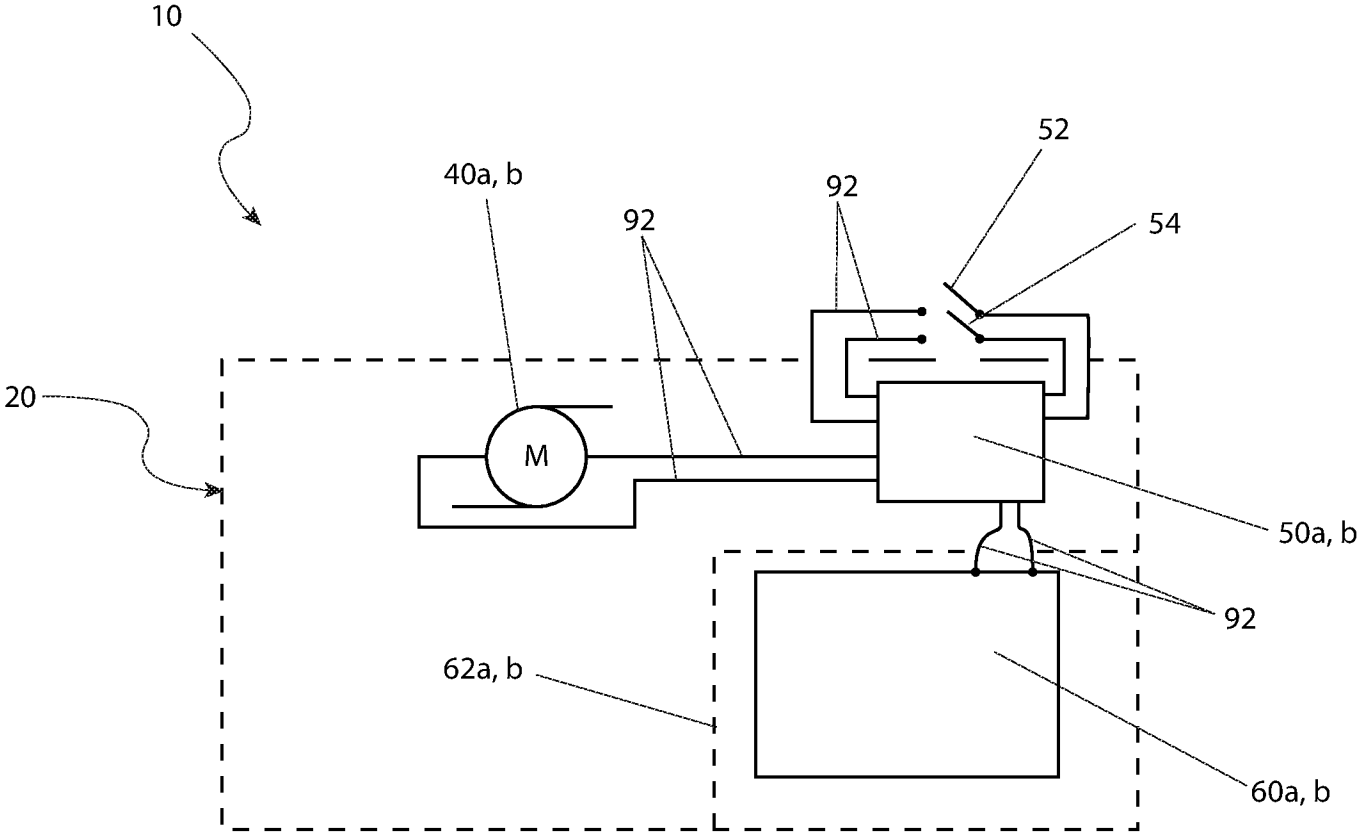

Referring to FIG. 5, each water propulsion assembly 28*a*, 28*b* (FIGS. 1 and 3) respectively includes the pump motor 40*a*, 40*b*, the motor control module 50*a*, 50*b*, the increase button switch 52, the decrease button switch 54, and the battery pack 60*a*, 60*b*. In the illustrative example of the device 10, the motor control module 50*a*, 50*b* and the speed button switches 52, 54 are integrated together. However, in other examples, the motor control module 50*a*, 50*b* and the speed button switches 52, 54 may be configured as discrete components and interconnected using wiring 92 with equal benefit and as such should not be interpreted as a limiting factor.

The components (e.g., 40*a*, 40*b*, 50*a*, 50*b*, 52, 54, 60*a*, 60*b*) of the device 10 illustrated in FIG. 5 represent individual water propulsion assemblies 28*a*, 28*b* and are in electrical communication with the motor control module 50*a*, 50*b* via interconnecting wiring 92. Each motor control module 50*a*, 50*b* houses and contains all electrical and electronic equipment necessary to power and control the functions of the device 10 such as, but not limited to: circuit boards, semi-conductors, discrete components, relays, embedded software, and the like.

During operation of the device 10, the motor control modules 50*a*, 50*b* receive input signals from the increase button switches 52 and the decrease button switches 54 resulting in respective increment and decrement of the output electrical power from the motor control modules 50*a*, 50*b* to the pump motors 40*a*, 40*b*, thereby correspondingly controlling the speed of the device 10 across the water surface 105. During operation of the device 10, repeated pressing of the decrease button switches 54 results in a completely halted state of the pump motors 40*a*, 40*b*, thereby bringing the device 10 to a complete stop when desired. Various other control functions, control components, and control configurations, in addition to, or in place of, the illustrated examples, may also be provided with equal benefit and as such should not be interpreted as a limiting factor.

It is envisioned that other styles and configurations of the disclosed device 10 can be easily incorporated into the teachings of the present disclosure and only certain configurations have be shown and described for purposes of clarity and disclosure and not by way of limitation of scope.

In example implementations of a disclosed method of use, the disclosed device 10 can be utilized in a simple and effortless manner with little or no training. It is envisioned that the device 10 would be constructed and utilized in general accordance with FIGS. 1-5.

An example of the disclosed method of installing and utilizing the device 10 may be achieved by performing the following steps: 1). procuring a model of the device 10 having a desired overall size and a desired external appearance; 2). removing the battery compartment lids 64 using the compartment lid latches 66; 3). removing the battery packs 60*a*, 60*b* from the battery compartments 62*a*, 62*b;* 4). providing an electrical charge to the two (2) battery packs 60*a*, 60*b* at a remote location using existing charging equipment; 5). installing the charged battery packs 60*a*, 60*b* into respective battery compartments 62*a*, 62*b;* 6). connecting the wiring 92 in a conventional manner; 7). replacing the battery compartment lids 64 using the compartment lid latches 66; 8). positioning the top board surface 26 of the flotation board assembly 20 against the chest of the user 100; 9). routing the neck straps 70*a*, 70*b* around a user's 100 neck and joining the neck straps 70*a*, 70*b* using the integral hook-and-loop fastener 76; 10). routing the side straps 72*a*, 72*b* in a parallel manner downwardly across the back of the user 100; 11). attaching the waist straps 74*a*, 74*b* snuggly around a user's 100 waist and joining the waist straps 74*a*, 74*b* using the integral hook-and-loop fastener 76; 12). allowing the user 100 to enter a body of water while assuming a swimming posture; 13). allowing the flotation board assembly 20 to be positioned generally parallel to the water surface 105 and partially or completely submerged below the water surface 105; 14). allowing the user 100 to press the increase button switches 52 repeatedly on one or both sides of the device 10, as needed, until obtaining a desired speed of travel across the water surface 105; 15). adjusting the speed and direction of the device 10 by pressing the increase 52 and decrease 54 button switches as desired; 16). allowing the user 100 to optionally correct the direction of travel the device 10, if desired, by angling their legs with respect to the flotation board assembly 20; 17). continuing to be propelled across the water surface 105 as desired; 18). bringing the device 10 to a halt, if desired, by repeatedly pressing the decrease button switches 54 until the water propulsion assemblies 28*a*, 28*b* cease running and the device 10 completely stops its forward motion; 19). allowing the user 100 to exit the body of water while still wearing the device 10; 20). removing the device 10 from the user 100 by detaching the hook-and-loop fastener portion 76 of the straps 70*a*, 70*b*, 74*a*, 74*b*; and 21). participating in an enjoyable individual water sport activity, afforded a user of the disclosed device 10.

Accordingly, in various examples, the disclosed device 10 is motorized and is capable of propelling the user 100 through the water. The front section of the device 10 is equipped with the swimming board assembly 20 that, during use, is positioned under the user 100 and at least partially submerged under water when the user 100 is floating, stomach down, on the water's surface 105. The swimming board 20 is equipped with two electrical DC motors (one (1) on each side) 40, each driving a jet pump 30 that has the impeller 34, which create thrust for propulsion. Each motor 40 is powered from the lithium-ion rechargeable battery pack 60, associated therewith, and has independent rotation speed control to allow for turning and other maneuvers. The swimming board assembly 20 is made of lightweight foam material and is provided with two (2) waterproof compartments that contain the DC motors 40, the batteries 60, and other control circuitry. It is envisioned that the disclosed device 10 can be used for recreational activities, but also could find use in water-based work activities such as construction/repair projects, rescue use, and the like. The use of the disclosed device 10 provides all the protection and safety of a conventional personal flotation device, but also provides for increased ease of mobility.

Generally, the materials required to produce the disclosed device 10 are all readily available and known to manufacturers of goods of this type. The device 10 would be made of foam and textiles following many of the same processes and procedures used for conventional personal flotation devices and life vests. The swimming board structure 22 would be made of foam in an injection molding process. Such a process would require the design and use of custom molds. The remaining components of the device 10, such as the motors 40, impellers 34, batteries 60, speed control circuits 50, wiring 92, and the like, would best be procured from manufacturers and wholesalers that deal in goods of that nature, and assembled at a final location. The relatively simple design of the device 10 and the material of construction, make the device 10 a cost-effective design due to the relatively low material and labor costs involved.

The exact specifications, materials used, and method of use may vary upon manufacturing. The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplate.

The invention claimed is:

1. A self-propelled personal flotation device comprising:

a board assembly;

a propulsion assembly connected to the board assembly and configured to generate thrust for propulsion; and, a strap assembly connected to the board assembly;

wherein the board assembly comprises a board structure having a top surface and a bottom surface;

wherein the propulsion assembly is located within an interior compartment of the board structure;

wherein the strap assembly comprises:

a first side strap comprising:

a first side strap-first end connected to a forward end of the board structure;

and, a first side strap-second end connected to a rearward end of the board structure; and, a second side strap comprising:

a second side strap-first end connected to the forward end of the board structure; and, a second side strap-second end connected to the rearward end of the board structure.

2. The device of claim 1, wherein the propulsion assembly comprises:

an intake located in the bottom surface of the board structure;

an output nozzle in fluid communication with the intake; and, a pump configured to draw water into the intake and discharge the water out from the output nozzle to generate the thrust.

3. The device of claim 2, wherein the pump comprises:

a pump body defining a pump channel between the intake and the output nozzle;

a motor:

a pump shaft connected to the motor and rotatable by the motor and extending into the pump channel; and, an impeller connected to the pump shaft and located in the pump channel between the intake and the output nozzle.

4. The device of claim 3, further comprising a control module operatively connected to the motor and configured to selectively control a rotational speed of the impeller.

5. The device of claim 3, wherein the propulsion assembly further comprises a battery operatively connected to the motor.

6. The device of claim 1, wherein the strap assembly further comprises:

a first neck strap comprising:

a first neck strap-first end connected to the forward end of the board structure; and, a first neck strap-second end; and, a second neck strap comprising:

a second neck strap-first end connected to the forward end of the board structure; and, a second neck strap-second end; and, wherein the first neck strap-first end and the second neck strap-second end are releasably connectable.

7. The device of claim 6, wherein the strap assembly further comprises:

a first waist strap comprising:

a first waist strap-first end connected to the first side strap; and, a first waist strap-second end; and, a second waist strap comprising:

a second waist strap-first end connected to the second side strap; and, a second waist strap-second end; and, wherein the first waist strap-first end and the second waist strap-second end are releasably connectable.

8. A self-propelled personal flotation device comprising:

a board structure having a first side and a second side, opposite the first side;

a first propulsion assembly connected to the board structure at the first side of the board structure and configured to generate first thrust for propulsion;

a first control module operatively connected to first motor and configured to selectively control a first rotational speed of the first impeller;

a second control module operatively connected to second motor and configured to selectively control a second rotational speed of the second impeller; and, a second propulsion assembly connected to the board structure at the second side of the board structure and configured to generate second thrust for propulsion and, wherein the board structure comprises:

a top surface;

a bottom surface, opposite the top surface;

a first interior compartment formed between the top surface and the bottom surface at the first side of the board structure; and, a second interior compartment formed between the top surface and the bottom surface at the second side of the board structure; and, wherein the first propulsion assembly is located within the first interior compartment of the board structure; and, wherein the second propulsion assembly is located within the second interior compartment of the board structure; and, wherein the first propulsion assembly comprises:

a first intake located in the bottom surface of the board structure;

a first output nozzle located at a rearward end of the board structure and in fluid communication with the first intake; and, a first pump configured to draw water into the first intake and discharge the water out from the first output nozzle to generate the first thrust; and, wherein the second propulsion assembly comprises:

a second intake located in the bottom surface of the board structure;

a second output nozzle located at the rearward end of the board structure and in fluid communication with the second intake; and, a second pump configured to draw water into the second intake and discharge the water out from the second output nozzle to generate the second thrust; and, wherein the first pump comprises:

a first pump body defining a first pump channel between the first intake and the first output nozzle;

a first motor:

a first pump shaft connected to the first motor and rotatable by the first motor and extending into the first pump channel;

a first impeller connected to the first pump shaft and located in the pump channel between the intake and the output nozzle; and, wherein the second pump comprises:

a second pump body defining a second pump channel between the second intake and the second output nozzle;

a second motor:

a second pump shaft connected to the second motor and rotatable by the second motor and extending into the second pump channel; and, a second impeller connected to the second pump shaft and located in the second pump channel between the second intake and the second output nozzle; and, wherein the propulsion system further comprises:

a first battery operatively connected to the first control module and the first motor;

and, a second battery operatively connected to the second control module and the second motor.

9. The device of claim 8, wherein:

the first control module comprises:

a first speed-increase selector switch configured to increase the first rotational speed of the first impeller; and, a first speed-decrease selector switch configured to decrease the first rotational speed of the first impeller; and, the second control module comprises:

a second speed-increase selector switch configured to increase the second rotational speed of the second impeller; and, a second speed-decrease selector switch configured to decrease the second rotational speed of the second impeller.

10. The device of claim 9, wherein a speed differential between the first rotational speed of the first impeller and the second rotational speed of the second impeller operates to control a forward direction of movement of the board structure.

11. The device of claim 8, further comprising a strap assembly connected to the board structure.

12. The device of claim 11, wherein the strap assembly comprises:

a first side strap comprising:

a first side strap-first end connected to the bottom surface at a forward end of the board structure; and, a first side strap-second end connected to the bottom surface at a rearward end of the board structure; and, a second side strap comprising:

a second side strap-first end connected to the bottom surface at the forward end of the board structure; and, a second side strap-second end connected to the bottom surface at the rearward end of the board structure;

a first neck strap comprising:

a first neck strap-first end connected to the bottom surface at the forward end of the board structure; and, a first neck strap-second end; and, a second neck strap comprising:

a second neck strap-first end connected to the bottom surface at the forward end of the board structure; and, a second neck strap-second end releasably connectable to the first neck-strap second end; and, a first waist strap comprising:

a first waist strap-first end connected to the first side strap; and, a first waist strap-second end; and, a second waist strap comprising:

a second waist strap-first end connected to the second side strap; and, a second waist strap-second end releasably connectable to the first waist strap-first end.

* * * * *